United States Patent [19]

Dubey

[11] Patent Number: 4,492,296

[45] Date of Patent: Jan. 8, 1985

[54] CIRCUIT ARRANGEMENT IN A COIN ACCEPTOR UNIT

[75] Inventor: Pierre Dubey, Le Pontet, Switzerland

[73] Assignee: Autelca AG, Gumligen, Switzerland

[21] Appl. No.: 326,920

[22] Filed: Dec. 2, 1981

[30] Foreign Application Priority Data

Dec. 5, 1980 [CH] Switzerland ..... 8979/80

[51] Int. Cl.[3] ..... G07D 5/08

[52] U.S. Cl. ..... 194/100 A

[58] Field of Search ..... 194/99, 100 A; 73/163

[56] References Cited

U.S. PATENT DOCUMENTS

| | | | |
|---|---|---|---|
| 4,105,105 | 8/1978 | Braum | 194/100 A |
| 4,286,704 | 9/1981 | Wood | 194/100 A |
| 4,326,621 | 4/1982 | Davies | 194/100 A |

FOREIGN PATENT DOCUMENTS

| | | | |
|---|---|---|---|
| 0062411 | 10/1982 | European Pat. Off. | 194/100 A |

OTHER PUBLICATIONS

"Data Acquisition Handbook, National Semiconductor", Published 1978 National Semiconductor Corp., Printed in West Germany, pp. 3-3, 3-5, 3-11, and 3-15.

"Digital/Analog and Analog/Digital Conversion Handbook", by Dominque Dumortier, Published 1980 by Motorola, Inc., pp. 6, 7, 58 and 60.

*Primary Examiner*—F. J. Bartuska

*Attorney, Agent, or Firm*—Brady, O'Boyle & Gates

[57] ABSTRACT

The coins (37) come within the coil field of an oscillator (2,6,7). Within a reverse feedback path of the oscillator amplifier (2), several resistances (11 to 18) are arranged, switchable parallel to each other individually or in any desired combination, by switching transistors (21 to 28), each controlled by a program (29). This makes the amplification controllable step by step. The program (29) has a constant-value-storage (49) with a stored standard value for the amplification in which oscillations cease whenever the field coil area is free and a calibrating resistance (35) is connected parallel to the condenser (7) of the oscillator (2,6,7). For each coin type, two predetermined standard limit values of amplification are stored in the constant-value-storage (49), with the oscillations ceasing between them in the presence of an acceptable coin (37). Prior to each testing operation, the program (29), with calibrating resistance (35) being connected parallel to the condenser (7) increases the amplification step by step until oscillations cease. The quotient of the thus obtained amplification value and the standard value is multiplied by the two standard limit values of each type of coin, and the product is stored in the read-write-memory (59) as the nominal limit value. During the coin testing, the amplification is altered step by step from the highest nominal limit value to the next lower, and so on. A coin acceptance signal is issued whenever the oscillator oscillations do not cease with the higher of the two nominal limit values and do stop with the lower of the two nominal limit values.

9 Claims, 2 Drawing Figures

CIRCUIT ARRANGEMENT IN A COIN ACCEPTOR UNIT

BACKGROUND OF THE INVENTION

The invention relates to circuit arrangements in coin acceptors.

Circuit arrangements in coin acceptor units, are know in the prior art, for accepting a coin whenever it causes the oscillation waves to stop, as well as circuit designs in which an inserted coin is accepted whenever it causes the oscillation to start. The circuit arrangement according to the principles of the present invention operates with the identical method as the first mentioned systems, in which the effect of the influence on the magnetic (or electric) field causing a reduction of the oscillation amplitude serves as the test criterion. However, in this invention, the coin is placed, instead of into the field of the self-induction coil of the oscillator, into the r.c. coupling field between a primary and a secondary r.c. coupling, causing an acceptance signal for the coin dependent on the reduction of the degree of the r.c. coupling caused by the coin, i.e. dependent on the reduction of the amplitude of the signal received.

It is the aim of any coin-testing apparatus to distinguish acceptable from non-acceptable coins as precisely as possible. In order to achieve this goal, it would be necessary, for instance, with the first mentioned circuit arrangement, to determine the attenuation limit of the oscillator which would be decisive for the test, and in which the oscillations would cease, exactly corresponding to the lower limit value of the range of conductivity of acceptable coins. Thus far, this has not been done, but a relatively large area of tolerance has been provided. This was necessary, because the limit conditions in which the oscillations start or cease, respectively, depend on the temperature and other influences. The resistance of the coil of the oscillator, for instance, and the transistor amplification depend on temperature conditions; in addition, metal residue inside of a dirty coin slot have an influence on the coil field and thereby on the attenuation.

The invention is based on the task of more exactly limiting the test tolerance range to the permissible range of tolerance for acceptable coins and on avoiding additional tolerances for changes in temperature and other influences.

It is the object of the present invention to provide a circuit in which the values determining the amplification are stored as amplification values, thus, for instance, the value of a control voltage regulating the amplification, or the reverse feedback—or feedback ratio or, respectively, the values of the resistances which influence the control voltage, the reverse feedback—or the feedback ratio.

In the circuit arrangement according to the invention, the standard value of the amplification indicates the very amplification with which, given normal conditions, the oscillations will cease or commence, respectively, whenever there is no coin in the area of the coil field. The oscillating circuit in this case may be attenuated either alone by its characteristic attenuation or by the additional hook-up of a resistor, which is not hooked up during the coin testing process. The resistor, in this instance, is so designed that it causes at least approximately the identical attenuation as an acceptable coin. If several types of coins must be tested, it is practical to design the resistor so that the attenuation it effects is approximately in the middle of the range of the attenuations caused by the various types of coins. In the preferred embodiment, therefore, the standard value of the amplification and the value of the amplification for an attenuation of the oscillating circuit existing prior to each coin testing procedure are determined, the attenuation approximating that caused by acceptable coins. With the preferred embodiment of the invention, therefore, it is possible to obtain nominal limit values of amplification, corresponding exactly to the prevailing conditions, if the relative change of the attenuation caused by operational conditions which deviate from normal conditions is not dependent on the total attenuation.

The same applies to the modified circuit arrangement of the invention.

Using the accompanying drawing, preferred embodiments of the invention are described in detail, in the specification hereinafter following.

DESCRIPTION OF THE PREFERRED EMBODIMENTS

Figure 1:
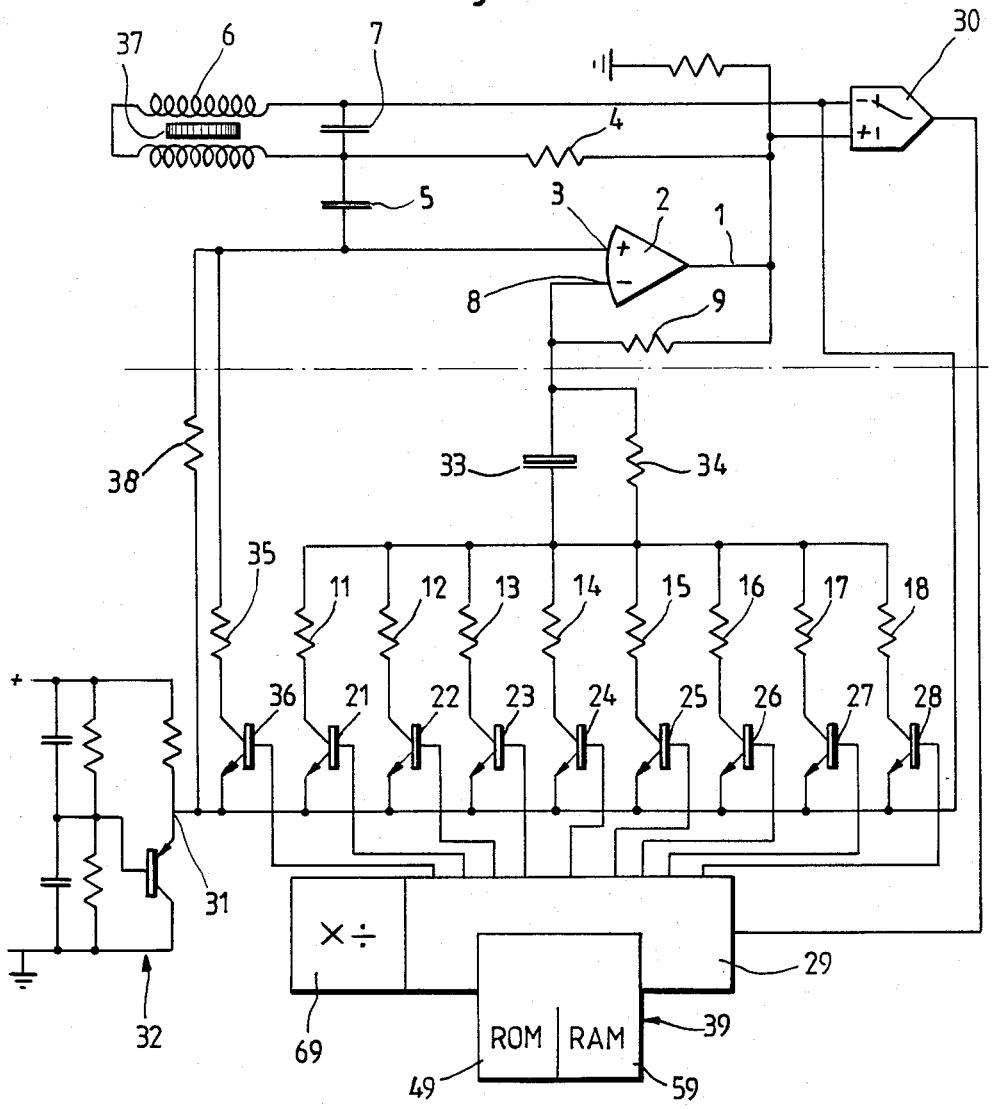
FIG. 1 is a schematic diagram of the circuit arrangement of the invention for a coin acceptor.

In the circuit arrangement shown in FIG. 1, the output 1 of an operation amplifier 2 is connected with the feedback input 3 of the latter by way of a feedback path 4 and 5, to which an oscillating circuit 6,7 is connected. A slot for coins (not shown) leads through the field of an oscillating circuit coil 6. Part of its output voltage rests at a reverse-feedback input 8 of the operation amplifier 2, being scanned at a potential distributor. The potential distributor consists of a fixed resistor 9, connected between the output 1 and the input 8 or of one or several resistors 11 to 18, which, by means of connection with one or several switching devices or switching transistors 21 to 28, can be connected into the potential distributor. The resistance value of the partial resistors 11 to 18 of the potential distributor, from which the reverse feedback voltage is taken, is adjustable in 255 steps. The switching transistors 21 to 28 can be charged individually or in combinations by means of a means connected to control the plurality of switching transistors 21 to 28 in the form of a programmed control device 29, permitting the adjustment of 255 different degrees of reverse feedback. This particular portion of the program, as will be described below, permits the adjustment of all of the 255, or of selected degrees of amplification in an increasing (or decreasing) sequence, step-by-step, and one after the other with circuitry that is well known in the art. A comparator circuit 30 compares the output signal of the amplifier circuit 2 with a reference voltage at the output 31 of a voltage stabilizer 32. The reactive impedance of a condenser 33, connected between the resistor 9 and resistors 11 to 18, is low, compared to that of a discharging resistor 34, connected in a parallel arrangement.

A calibrating resistor 35 can be connected parallel to the oscillator circuit condenser 7 by means of a transistor 36. The resistor 35, when it is connected parallel to the oscillating circuit 6,7 by operation of transistor 36, has the same effect as a coin 37 of a definite acceptable type within the area of coil field 6. It is practical to select, from the various types of coins, such coin as will effect a mean attenuation of the oscillating circuit, relative to the attenuation range caused by all of the coins. Resistor 35 is low in resistance compared to a resistor 38 through which the stabilized d.c. voltage at the output 31 is taken to the amplifier input 3.

The programmed control device has a memory 39 with two memory parts, one, a constant-value storage 49 (ROM or REPROM), and a read-write memory 59 (RAM), as well as an arithmetic unit 69.

In the constant-value storage 49, one standard value of the amplification as well as two pre-determined standard limit values of the amplification for each acceptable type of coin are stored. The stored amplification values are the resistance values of the voltage-divider partial resistors 11–18, from which the reverse feedback voltage is taken. Storage is performed together with a code, indicating which of the transistors 21 to 28 is conductive and which is not.

The standard value of the amplification is determined under normal conditions (temperature, operational voltage) and without the presence of a coin within the range of the coil field 6, as follows: First, the resistor 35, by activating transistor 36 is switched parallel to the oscillating circuit 6,7. Then, the program 29 activated transistors 21–28 are operated in such a manner, that the partial resistance 11 to 18 i.e. the parallel resistance value of those resistors 11 to 18 which are connected in parallel by the respective switching transistors 21 to 28 to the reference voltage at output 31, beginning with the lowest of the 225 resistance values (in which case all transistors 11 to 18 are activated) is increased step by step. With the lowest resistance value, the feedback is minimal, and the amplification, therefore, at a maximum and oscillator 2, 6, 7 is oscillating. The comparator 30, in the rhythm of the upper half-wave of the oscillator waves gives impulses to the program 29. During the course of the step-by-step increase of the partial resistance 11 to 18, a resistance level is reached in which oscillation ceases because of the increased reverse feedback ratio, or the reduced amplification, respectively. As soon as the oscillation amplitude at the output 1 is smaller than the reference voltage at output 31, the impulses issued periodically by the comparator 30 come to a halt. The resistance value of this resistance step 11 to 18 is stored in the constant-value storage 49 as the standard value of the amplification. As mentioned before, for each acceptable type of coin, two standard limit values of amplification are stored in the constant-value storage 49. These values are determined in a similar manner as the standard value of the amplification: First, transistor 36 is inhibited, so that the resistor 35 is not connected with the oscillating circuit 6,7. Then, a coin of the acceptable type is placed within the field of coil 6. Under normal operating conditions, and in the same way as for the determination of the standard values of the amplification, the partial resistances 11 to 18, are increased step by step, until a level of resistance has been reached where the oscillations cease. Two values are then entered in the constant-value storage 49 as standard limit values of amplification, one of which being smaller by one tolerance and the other being larger by one tolerance then the level of resistance attained. For the purpose of strict testing, the tolerances will be selected corresponding precisely to the permissible tolerance range of acceptable coins of the type used. The standard limit values of the amplification can also be determined by inserting one coin each representing the uppermost and the lowermost limit of the range of tolerance, into the field of coil 6, the resistance value of the partial resistance 11 to 18 being determined, causing the oscillations to cease.

Operation of the circuit arrangement starts upon an initiation signal being provided from a coin detector located at the entrance to the coin slot—which is not shown. At the occurrence of that signal from the coin detector, the programmed control device 29 activates transistor 36. When transistor 36 is activated, the resistance 35 is connected in parallel to the oscillating circuit 6, 7. The programmed control device 29 then executes operations described in the following paragraph, which operations comprise a first part of an internal program and being terminated and completed before the inserted coin reaches the field of coil 6.

During the first part of the program, a recalibration in effect takes place wherein the programmed control device 29 switches the switching transistors 21 to 28 step-by-step in such a way that the parallel resistance value of those resistors 11 to 18, which are connected in parallel by the respective switching transistors 21 to 28 to the reference voltage at output 31 beginning with the lowest of the 255 resistance values (all transistors 11 to 18 activated) is increased step-by-step. After each switching step the control device 29 checks whether or not pulses are being received from comparator 30. If pulses are being received from the comparator 30, the programmed control device 29 switches the switching transistors 21 to 28 such that the actual resistance value is increased by a further step. If no pulses are being received from the comparator 30, the programmed control device 29 stops the switching of the switching transistors 21–28 and calculates by means of the arithmetic unit 69 the ratio of the actual parallel resistance value to the standard value of the amplification stored in the constant-value storage 49. (As mentioned above, the stored standard value of the amplification is a resistance value.) It is clear that the ratio thus obtained is not equal to "1" if the conditions, e.g. the temperature conditions, are other than normal. The programmed control device 29 then multiplies by means of arithmetic unit 69 the ratio thus obtained with the two predetermined standard limit values of each type of coin stored in the constant-value storage 49. The results thus obtained are stored as the two nominal limit values of each type of coin in the read-write memory 59. Transistor 36 then is inhibited by the programmed control device 29. This concludes the first part of the program.

The second part of the program is concerned with an actual testing of a coin and is started by the programmed control device 29 as soon as the coin 37 is in the field of coil 6. The starting of the second part of the program can be triggered either by a pre-set time subsequent to the signal of the coin detector arranged at the entrance to the coin slot or by a second coin detector arranged immediately prior to coil 6. In this second part of the program the programmed control device 29 executes the operations described in the following paragraph.

During the second part of the program, the programmed control device 29 switches the switching transistors 21–28 step-by-step in the same way as described in connection with the first part of the program. Hence the resistance value beginning with the lowest of the 255 resistance values is increased step-by-step. After each switching step the programmed control device 29 checks whether or not pulses are being received from comparator 30 and if so, continues to switch the switching transistors 21 to 28 in order to increase the actual resistance value by a further step. If not, the programmed control device 29 stops the switching of the switching transistors 21–28 and compares the actual resistance value with the two nominal limit values of each type of coin stored in the read-write memory 59. A coin acceptance signal is provided if the comparison reveals that the actual resistance value at the point at which the pulses from the comparator 30 stop is between the two nominal limit values of a particular type of coin. Since comparator 30 outputs pulses as long as the oscillator 2, 6, 7 oscillates, it is apparent that a coin acceptance signal is generated if the level of resistance at which the oscillations cease is between the two nominal limit values of a type of coin.

Testing of a coin according to the above described program is somewhat time consuming because not only in the first but again in the second part of the program all 255 resistance steps are run through from the bottom to the top until the pulses from the comparator 30 stop. In order to achieve a faster coin testing operation, the program described above is modified in that in the second part of the program not all of the resistance steps (255 resistance values) are run through but only those values which correspond to the two stored nominal limit values for each type of coin are utilized. In the second part of the program the programmed control device 29 switches the switching transistors 21 to 28 in a sequence such that the parallel resistance value of the resistors 11 to 18, beginning with the lowest of the selected resistance values or nominal limit values respectively stored in memory 59 is increased to the next higher selected resistance value or nominal limit value respectively stored.

Again as in the program explained first, the programmed control device 29 checks whether pulses are being received from comparator 30 and if so, switches the switching transistors 21 to 28 such that the actual resistance value assumes the next higher selected resistance value or nominal limit value respectively stored in memory 59 and if not, stops the switching of the switching transistors 21 to 28. A coin acceptance signal is now provided in the case that the switching of the transistors 21 to 28 is inhibited at a point at which the actual resistance value assumes the upper nominal limit value of any particular type of coin. It is clear from the foregoing that this case occurs only if the pulses from the comparator 30 have continued at the lower nominal limit value of a particular type of coin but have ceased at the upper nominal limit value of this particular type of coin with the exact resistance value at which the pulses from the comparator 30 or oscillations respectively cease lying between the two nominal limit values thereof.

Testing by means of the method of case (a) is advantageous because it is much faster than in the case of (b).

In the embodiment described, the oscillator 2,6,7 is oscillating in its quiescent state, the partial resistance 11 to 18 is increased step-by-step. It is understood that the oscillator could also be calm in its quiescent state and the partial resistance could, beginning with the highest resistance value or, respectively, the largest stored nominal limit value, be decreased step-by-step, until a resistance level has been reached where the oscillator begins to oscillate. In this case, the amplification would not be reduced but increased step-by-step.

Figure 2:
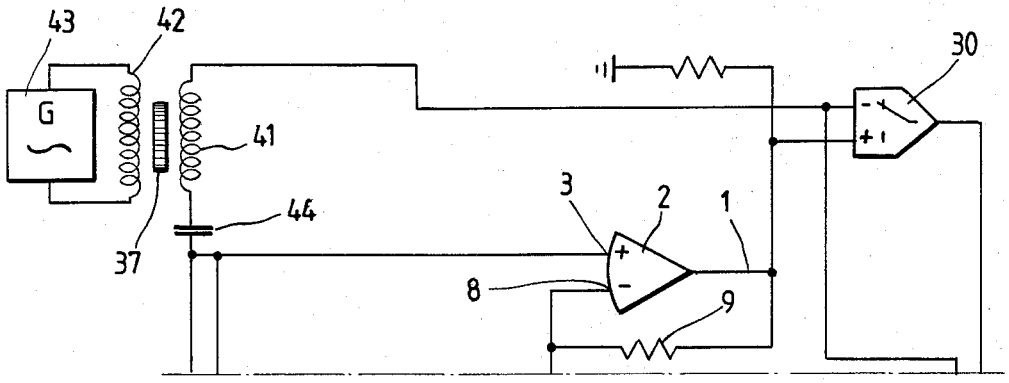
FIG. 2 shows a modified form of a portion of the circuit of FIG. 1.

The modified circuit arrangement according to FIG. 2 is distinguished from that according to FIG. 1 by that part of the circuit which can be seen above the line drawn in dots and dashes. Here, the feedback path 4,5 is done away with, and the operation amplifier 2 is connected inductively by a coil 41 forming a secondary r.c. coupling with a coil 42, forming a primary r.c. coupling of an a.c. generator (or oscillator, respectively) 43. Here, the coin 37 enters the coupling field between the two coils 41, 42 and changes the degree of coupling. The transmitted signal reaches the amplifier input 3 by way of a condenser 44. The comparator 30 compares the amplitude of the output signal of the amplifier 2 with the reference voltage at the output 31 and, in the rhythm of the upper half-wave of the transmitted and amplified a.c. signals sends signals to the program 29 until the signal amplitude falls beneath the reference voltage, during a corresponding reduction of the degree of coupling. For the rest, the circuit arrangement of FIG. 2 operates in accordance with the circuit arrangement of FIG. 1: Here, too, a standard amplification value is stored in the constant-value-storage 49. In order to determine this standard value, the partial resistance 11 to 18—while the coupling field is free and the resistance 35 is connected parallel to coil 41—is increased step by step, beginning with the lowest resistance value, until such resistance level and thus the amplification level has been reached in which the amplitude of the output signal of the amplifier 2 is equal to the reference voltage at the output 31, or if it is less, the resistance value of the resistance level attained is then stored as the standard value of the amplification. Equally, for each type of coin, two pre-determined standard limit values of the amplification or the partial resistance 11 to 18, respectively, are stored, between them the amplitude of the output signal of the amplifier 2 accepts the reference voltage in the presence of an acceptable coin 37. The testing of the coin is again analogous to the one described before, because the program control 29 prior to the coin being tested step-by-step increases the partial resistance 11 to 18 until the output amplitude of the amplifier 2 assumes the reference voltage or falls below it. The arithmetic unit 69 then multiplies the quotient of the thus obtained value of the partial resistance 11 to 18 and the standard value with the lower and upper standard limit values for each type of coin stored in the constant-value-storage 49. For each of the lower and upper limit values thus calculated, the next resistance level below and the next resistance level above it are stored in the RAM memory 59 as the lower and the upper nominal limit value for the type of coin in question. During the testing of the coins, the partial resistance 11 to 18 again is increased step-by-step. If it is increased over all of the 255 resistance steps, a coin-acceptance signal is given whenever the output signal amplitude of the amplifier 2 assumes the reference voltage at the output 31, if the value of the resistance level attained in doing so is between the two nominal limit values. If only the nominal limit values of the resistant levels stored in the RAM storage 59 are run through from the bottom to the top, a coin acceptance signal is given whenever the amplitude of the amplifier output signal exceeds the reference voltage at the smaller of the two resistance nominal limit values of a type of coin, and whenever it falls below the said reference voltage of the higher value. It is understood that the partial resistance could also be reduced step-by-step, beginning with the highest resistance value.

The precision of the coin testing in the embodiments as described does not depend on any extrinsic influences, it merely is limited by the number of the amplification values which are adjustable by means of the partial resistances 11 to 18. A minor increase of the number of resistances 11 to 18 (and of the corresponding switching transistors 21–28) causes a considerable increase in the number of the adjustable amplification values and an increased accuracy.

Basically, the resistances 11 to 18 may be switched into the feedback path of the oscillator instead of into the reverse feedback path. The advantage of the arrangement within the reverse feedback path consists in the fact that it does not effect the quality of the oscillation circuits, essential for an exact and selective coin testing operation.

The control of the amplification could be handled by condensers instead of by the resistances 11 to 18.

It is possible to provide an oscillator circuit with two coupled oscillation circuits instead of the oscillator circuit 2,6,7 as shown in FIG. 1, having one oscillating circuit 6,7, with the coin entering their coupling field. In this case, the circuit could be so designed that the oscillation commences as soon as an acceptable coin comes within the range of the coil field.

In the embodiment of FIG. 2, capacitative couplings could be provided instead of inductive couplings, and their electric field could be influenced by the coin.

The first part of the program as described in connection with FIG. 1 could be shortened in that the step-by-step augmentation of the partial resistances 11 to 18, instead of beginning with the lowest resistance value, start with a higher resistance value, which is so selected that the oscillation does not stop even under the most extreme of conditions (temperature, extremely dirty coin channel).

Also, even as early as during the manufacturing stage of the coin acceptors, pre-selected standard limit values for the entire coin testing series could be stored in the ROMs 49, as well as a pre-determined standard value of amplification (and the partial resistance 11 to 18, respectively). In the first program part, as described in connection with FIG. 1, the value of the partial resistance 11 to 18 is determined in the manner afore described, with which the oscillations cease whenever the resistance 35 is switched parallel to the oscillating circuit 6,7 and no coin is within the range of the coil field 6. In the first program part, the arithmetic unit 69 determines only the difference between that value and the pre-selected standard value stored in the ROM 49, and it stores this difference as the correction value in the RAM 59. (Therefore, no nominal limit values are calculated as yet.) In the second program part, the arithmetic unit 69 determines one after the other, all nominal limit values, by adding the correction value stored in the RAM 59 to the pre-determined standard limit values stored in the ROM 49. Immediately after the calculation of each nominal limit value, the corresponding resistance level 11 to 18 is adjusted and it is observed in the afore described manner whether the oscillations stop.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A circuit for a coin acceptor unit in which the coin (37) to be tested comes into the coil field of an oscillator (2,6,7), a coin acceptance signal being created dependent upon the condition whether the coin (37) will stop or start the oscillations, respectively, comprising an oscillator amplifier (2,6,7), a plurality of switching devices (21–28) connected with said oscillator amplifier, means (29) connected to control said plurality of switching devices (21–28), the amplification of the oscillator amplifier (2,6,7) being controllable step-by-step by means of said means (29) connected to control said plurality of switching devices, said means (29) connected to control said plurality of switching devices having a memory (39) in which a standard value of amplification is stored, with which the oscillations stop or start, respectively, whenever the coil field (6) is free, and two pre-determined standard limit valves of amplification being stored for each type of coin, the oscillations stopping or starting, respectively, between the said values in the presence of an acceptable coin; said means (29) connected to control said plurality of switching devices prior to each coin testing procedure by switching said plurality of switching devices (21–28) altering step-by-step the amplification until oscillations stop or start, respectively, an arithmetic unit (69) connected with said means (29) creating from the relation of the thus obtained amplification value to their standard value and the two standard limit values of each type of coin two nominal limit values each for the amplification, altering the said amplification step-by-step during the testing process and a comparator including means issuing a coin acceptance signal if the oscillations stop or start, respectively, between the two nominal limit values of a type of coin.

2. A circuit as defined in claim 1, including a resistance (35), a switching transistor (36) connected with said resistance (35), said resistance (35) being connectable by means of said switching transistor (36) to the oscillating circuit (6,7) of the oscillator (2,6,7), said resistance (35) being so selected that it affects at least approximately the same attenuation of the oscillating circuit (6,7) as an acceptable coin (37), and the standard value of the amplification stored in the memory (39) being the value with which the oscillations stop or start, respectively whenever the resistance (35) is switched to the oscillating circuit (6,7) and by the resistance (35), prior to each coin testing process during the step-by-step alteration of the amplification being switched to the oscillating circuit (6,7), while it is not switched thereto during the coin testing process.

3. A circuit as defined in claims 1 or 2, wherein said means (29) connected to control said plurality of switching devices (21–29) comprises a programmed control device and including several switching transistors (21–28) connected to said program device (29), several resistances (11 to 18) or condensers being individually or in combination switchable parallel to each other by one each switching transistor (21–28) controlled by the programmed control device (29), within a reverse feedback path of the oscillator amplifiers (2).

4. A circuit as defined in claim 1, including a threshold value detector (30), said oscillator amplifier (2) having an output (1) connected to the threshold value detector (30), giving signals indicating the oscillation of the oscillator (2,6,7), not giving a signal whenever a predetermined threshold value of the oscillation amplitude is not reached or else giving a signal indicating the attenuation of the oscillations.

5. A circuit as defined in claim 1 for the testing of various types of coins, wherein said means (29) connected to control said plurality of switching devices (21–29) comprises a programmed control device and in which the programmed control device (29) during the coin testing process reduces in step-by-step fashion the amplification of the amplifier (2) of the oscillator (2, 6, 7), oscillating in its quiescent state, from the highest to the next following lower nominal limit value, generates a coin acceptance signal whenever the oscillations do not cease with the higher of the two nominal limit values of a type of coin while they cease with the lower value, or increases the amplification of the amplifier (2) of the oscillator (2, 6, 7), not oscillating in its quiescent state, step-by-step from the lowest nominal limit value to the next higher nominal limit value, and generates a coin acceptance signal whenever the oscillations do not commence with the lower of the two limit values of a type of coin and whenever they commence with the higher one.

6. A circuit for a coin acceptor unit in which the coin (37) to be tested comes into the coupling field between an alternating current (43) primary coupling (42) and a secondary coupling (41), and a coin acceptance signal being created dependent upon the thereby effected change in the degree of coupling, comprising an amplifier (2) being connected to the secondary coupling (41), a threshold value detector (30), said amplifier having an output (1) connected with the threshold value detector (30), a plurality of switching devices (21–28) connected with said amplifier, means (29) connected to control said plurality of switching devices (21–28) whereby the amplification of t..e amplifier (2) being step-by-step controllable by means of, said means (29) connected to control said plurality of switching devices, said means (29) connected to control said plurality of switching devices having a memory (39) in which the standard value of amplification is stored, the output signal of the amplifier (2), given a free coupling field, being equal to the threshold value, and for each type of coin two predetermined standard limit values of the amplification being stored, between the two said values the output signal of the amplifier (2) assuming the threshold value in the presence of an acceptable coin; said means (29) connected to control said plurality of switching devices prior to each coin testing process step-by-step increasing or decreasing the amplification, until the output signal of the amplifier (2) assumes the threshold value or, respectively, exceeds or falls below the said value, an arithmetic unit (69) connected with said means (29) creating two nominal amplification values in addition to their standard value and the standard limit values, while, during the coin testing process, step-by-step augmenting or reducing the amplification and a comparator including means giving a coin acceptance signal whenever the output signal of the amplifier (2) assumes the threshold value when the amplification is between the two nominal limit values or when the output signal of the amplifier (2) falls below the said threshold value at the lower of the nominal limit values and exceeds it at the higher.

7. A circuit as defined in claim 6, including a switching transistor (36), a resistance (35) being connectable parallel to the secondary coupling (41) by means of said switching transistor (36), said resistance (35) being so selected that it reduces the signal at the secondary coupling (41) at least approximately as an acceptable coin (37) within the coupling field, and the standard value of the amplification stored in the memory (39) being that value with which the output signal of the amplifier (2) is equal to the threshold value, whenever the resistance (35) is connected in parallel with the secondary coupling (41), the resistance, prior to each coin testing process, during the step-by-step alteration of the amplification being switched in parallel to the coupling (41), while not being switched during the coin testing process.

8. A circuit as defined in claim 6, wherein said means (29) connected to control said plurality of switching devices (21–29) comprises a programmed control devices and including several switching transistors (21–28) connected to said programmed control device (29), a reverse feedback input (8) for said amplifier (2), several resistances (11 to 18) or condensers being individually or in combination connectable to said reverse feedback input (8) of the amplifier (2), parallel to each other, by one each of said several switching transistors (21–28), controlled by the programmed control device (29).

9. A circuit as defined in claim 6 for the testing of various types of coins, wherein said means (29) connected to control said plurality of switching devices (21–29) comprises a programmed control device and in which the programmed control device (29), during the coin testing process, reduces the amplification step-by-step, beginning with the highest nominal limit value down to the next lower value, gives a coin acceptance signal whenever the amplifier output signal exceeds the threshold value with the higher of the two nominal limit values of a type of coin or whenever it falls below it in the presence of the lower value or, increases the degree of amplification step-by-step, beginning with the lowest nominal limit value, increases it to the respective next higher one, and gives a coin acceptance signal whenever the amplifier output signal falls below the threshold value in the presence of the lower of the two limit values of a type of coin or while exceeding it with the higher value.

* * * * *